US012631431B1

(12) United States Patent
Burger

(10) Patent No.: US 12,631,431 B1
(45) Date of Patent: May 19, 2026

(54) FUSE ASSEMBLY AND METHOD FOR ASSEMBLING THE SAME

(71) Applicant: L3Harris Technologies, Inc., Melbourne, FL (US)

(72) Inventor: John Pierce Burger, Cincinnati, OH (US)

(73) Assignee: L3Harris Technologies, Inc., Melbourne, FL (US)

( * ) Notice: Subject to any disclaimer, the term of this patent is extended or adjusted under 35 U.S.C. 154(b) by 0 days.

(21) Appl. No.: 19/173,156

(22) Filed: Apr. 8, 2025

(51) Int. Cl.

| | |
|---|---|
| ***F42B 3/11*** | (2006.01) |
| ***F42B 3/12*** | (2006.01) |
| ***F42C 19/02*** | (2006.01) |
| ***F42C 19/08*** | (2006.01) |

(52) U.S. Cl.
CPC ..... *F42B 3/125* (2013.01); *F42B 3/11* (2013.01); *F42B 3/12* (2013.01); *F42B 3/124* (2013.01); *F42C 19/02* (2013.01); *F42C 19/0838* (2013.01)

(58) Field of Classification Search
CPC .. F42B 3/124; F42B 3/125; F42B 3/10; F42B 3/11; F42B 3/12; F42B 3/121; F42C 19/00; F42C 19/02; F42C 19/0838
USPC ..... 102/202.7, 202.14
See application file for complete search history.

(56) References Cited

U.S. PATENT DOCUMENTS

| | | | | |
|---|---|---|---|---|
| 5,035,181 | A * | 7/1991 | Jacks | F42C 19/02 102/293 |
| 7,549,374 | B2 * | 6/2009 | Schwantes | F42C 1/10 102/275.9 |
| 7,661,362 | B2 * | 2/2010 | Hennings | F42B 3/127 102/202.1 |
| 7,930,975 | B2 * | 4/2011 | Cotet | F42B 39/20 102/202.1 |
| 7,971,533 | B1 * | 7/2011 | Berlin | F42C 19/02 102/275.9 |
| 8,234,979 | B1 * | 8/2012 | Falabella | F42C 11/00 102/275.9 |
| 8,430,028 | B2 * | 4/2013 | Biggs | F42B 3/11 102/202.5 |
| 9,879,951 | B2 * | 1/2018 | Biggs | F42C 14/00 |
| 10,267,604 | B1 * | 4/2019 | Morales | F42B 3/124 |
| 11,009,319 | B1 * | 5/2021 | Morales | F42B 3/103 |
| 11,047,666 | B1 * | 6/2021 | Blazek | F42B 12/207 |
| 11,131,533 | B1 * | 9/2021 | Albrecht | F42C 19/02 |
| 11,450,500 | B1 * | 9/2022 | Albrecht | H01H 85/0017 |
| 11,644,286 | B1 * | 5/2023 | Morales | F42B 3/125 102/202.7 |

* cited by examiner

*Primary Examiner* — James S Bergin
(74) *Attorney, Agent, or Firm* — Edell, Shapiro & Finnan, LLC

(57) ABSTRACT

A fuse assembly that includes a low energy exploding foil initiator (LEEFI) located in a housing thereof. The LEEFI is supported in the housing by a sleeve made of a compliant material that protects the LEEFI by dampening shocks and vibrations applied to the housing. At least a portion of the LEEFI is press-fit into the sleeve such that an interference fit exists between an outer cylindrical wall of the LEEFI casing and in inner wall of the housing. The sleeve includes a latch assembly at one end having a plurality of tabs that are circumferentially spaced-apart from one another. Each of the plurality of tabs includes a cantilever beam having a head, the head including a bottom surface pressed against a top surface of the external annular flange of the LEEFI casing.

18 Claims, 8 Drawing Sheets

FUSE ASSEMBLY AND METHOD FOR ASSEMBLING THE SAME

TECHNICAL FIELD

The present invention relates to fuse assemblies that incorporate a low energy exploding foil initiator (LEEFI) and methods for assembling the same.

BACKGROUND

A low energy exploding foil initiator is a detonator frequently used in modern weapon designs and aerospace technology. It is designed to detonate pressure sensitive explosive materials in the first stage of an explosive chain. It works by using a high-current pulse to cause a metal foil to explode, creating a plasma that drives a flyer to impact an explosive, initiating its detonation.

A low energy exploding foil initiator typically includes a small capacitor charged to a high voltage, a switch, a transmission line, an exploding foil (bridge foil), and a flyer. When the capacitor discharges through the metal foil via the transmission line, the foil is heated rapidly, causing it to explode and generate a high-temperature, high-pressure plasma. This expanding plasma drives the flyer (a thin plastic or metal foil) across a gap, propelling it to a high velocity. The high-velocity impact of the flyer on a secondary explosive delivers the energy and shock needed to initiate a detonation.

In some prior art fuse assemblies the LEEFI is located inside a housing with one end of the device supported on an electrical isolator that is in turn supported on one or more electronic boards (e.g. printed circuit boards) to which electrical leads of the LEEFI are directly coupled. These components are held fixed to the housing that contains the LEEFI by the use of screw-type fasteners. One problem with this design is that the stacking arrangement of parts for supporting the LEEFI is not conducive to reduced package sizing. Another problem is that the screws used to hold the one or more electronic boards onto the housing are susceptible to causing cracks in the electronic board(s) during or after assembly.

SUMMARY

Disclosed herein is a fuse assembly that includes a housing having a low energy exploding foil initiator (LEEFI) located therein. In use, the housing is attached to, for example, a munitions platform that includes a bomb that is configured to be detonated by the LEEFI. The LEEFI is supported in the housing by a sleeve made of a compliant material that protects the LEEFI by dampening shocks and vibrations applied to the housing. According to some implementations the sleeve is a monolithic structure made of a single piece of material.

Components of the LEEFI reside inside a casing that is press-fit into the sleeve such that an interference fit exists between an outer wall of the casing and in inner wall of the housing. One end of sleeve includes an upper latch assembly that has a plurality of tabs that are circumferentially spaced-apart from one another. Each of the plurality of tabs includes a cantilever beam having a head with a bottom surface pressed against an upper end surface of the LEEFI casing. According to some implementations the upper end surface of the LEEFI casing is a part of an external annular flange of the casing.

According to some implementations the head of each of the plurality of tabs includes a chamfered top surface that facilitates an insertion of the LEEFI casing into the sleeve.

According to some implementations the housing and sleeve include additional features that work together to restrict axial movement of the sleeve inside the housing. According to some implementations these features include an annular groove formed in an inner wall of a through opening of the housing and an annular protrusion of the LEEFI casing that resides in the annular groove. Alternatively or in conjunction with the use of the annular groove and protrusion to restrict axial movement of the sleeve inside the housing, the housing may include one or more annular shelves on which respective one or more bottom facing surfaces of the sleeve rest.

According to some implementations the fuse assembly further includes a band (e.g. O-ring) that circumscribes the plurality of tabs with at least a portion of the band residing in a groove of each of the cantilever beams. The function of the band is to restrict radial outward movement of the cantilever beams when the assembly is subjected to shock and vibrations.

According to some implementations the LEEFI includes a plurality of electrical leads protruding from an end of the casing that are electrically coupled to a respective one or more conductors (e.g. traces) of a flexible electrical connector. According to some implementations the one or more electrical leads are electrically coupled to a remote printed circuit board by the flexible electrical connector. According to some implementations the printed circuit board comprises circuitry for controlling the activation of the LEEFI and is located in a part of the housing spaced away from the LEEFI.

Also disclosed herein are methods for mounting the LEEFI inside the housing. One method involves a first insertion process followed by a second insertion process.

According to some implementations the first insertion process includes inserting the sleeve into the through opening of the housing. As noted above, the through opening of the housing is at least partially defined by an inner wall of the housing and the inner wall has an annular groove formed therein. The sleeve has an outer circumferential surface that advances axially into the through opening of the housing during the first insertion process until the annular protrusion of the sleeve resides inside the annular groove of the housing. The housing further includes a shelf that protrudes radially inward from the inner wall. The sleeve, in turn, includes a bottom surface that is caused to rest against the shelf when the first insertion process is complete. These features fix the axial position of the sleeve inside the housing.

The second insertion process includes inserting the LEEFI casing into a through opening of the sleeve so that the sleeve is disposed between the LEEFI casing and the inner wall of the housing. As a result of an outer diameter of the LEEFI casing being slightly larger than an inner diameter of the through opening of the sleeve, at least a portion of the LEEFI casing is press-fit into the sleeve such that an interference fit exists between a circumferential wall of the LEEFI casing and the inner wall of the housing.

The sleeve also includes an annular shelf on which at least a portion of an external annular flange of the casing rests when the second insertion process is complete. According to some implementations an upper surface of the annular shelf faces and is spaced apart from the bottom surfaces of the tabs of the upper latch assembly.

During the insertion of the LEEFI casing into the through opening of the sleeve, a bottom surface of the casing acts on the chamfered surfaces of the cantilever beams to cause the beams to flex radially outward to make way for the axial passage of the casing into the through opening of the sleeve. Upon the upper annular flange of the LEEFI casing advancing a sufficient distance into the sleeve, the cantilever beams subsequently flex radially inward to cause their heads to press against the top surface of the casing. Concurrently therewith, or at a time thereafter, the bottom surface of the external annular flange of the LEEFI casing is caused to be pressed against the annular shelf of the sleeve.

According to some implementations the housing includes a second annular shelf located above the first annular shelf with the annular groove in the inner wall being disposed between the first and second annular shelves. In such instances, the sleeve may possess a lip with a bottom surface that is caused to press against a top surface of the second annular shelf when the first insertion process is complete.

According to some implementations, when the second insertion process is complete, a band is applied around the cantilever beams so that an inner surface of the band presses against the outer surfaces of the cantilever beams to restrict radial outward movement of the cantilever beams when the assembly is subjected to environmental loads (e.g. shock and/or vibration).

The fuse assembly features discussed above beneficially result in a uniform clamp loading on the LEEFI that minimizes the occurrence of localized stress points brought about by the use of other types of fastening means (such as threaded and/or bolted connections). Further, more compact designs are achievable by eliminating the need for LEEFI board stack.

These and other advantages and features will become apparent in view of the figures and the detailed description.

DETAILED DESCRIPTION

Figure 1:
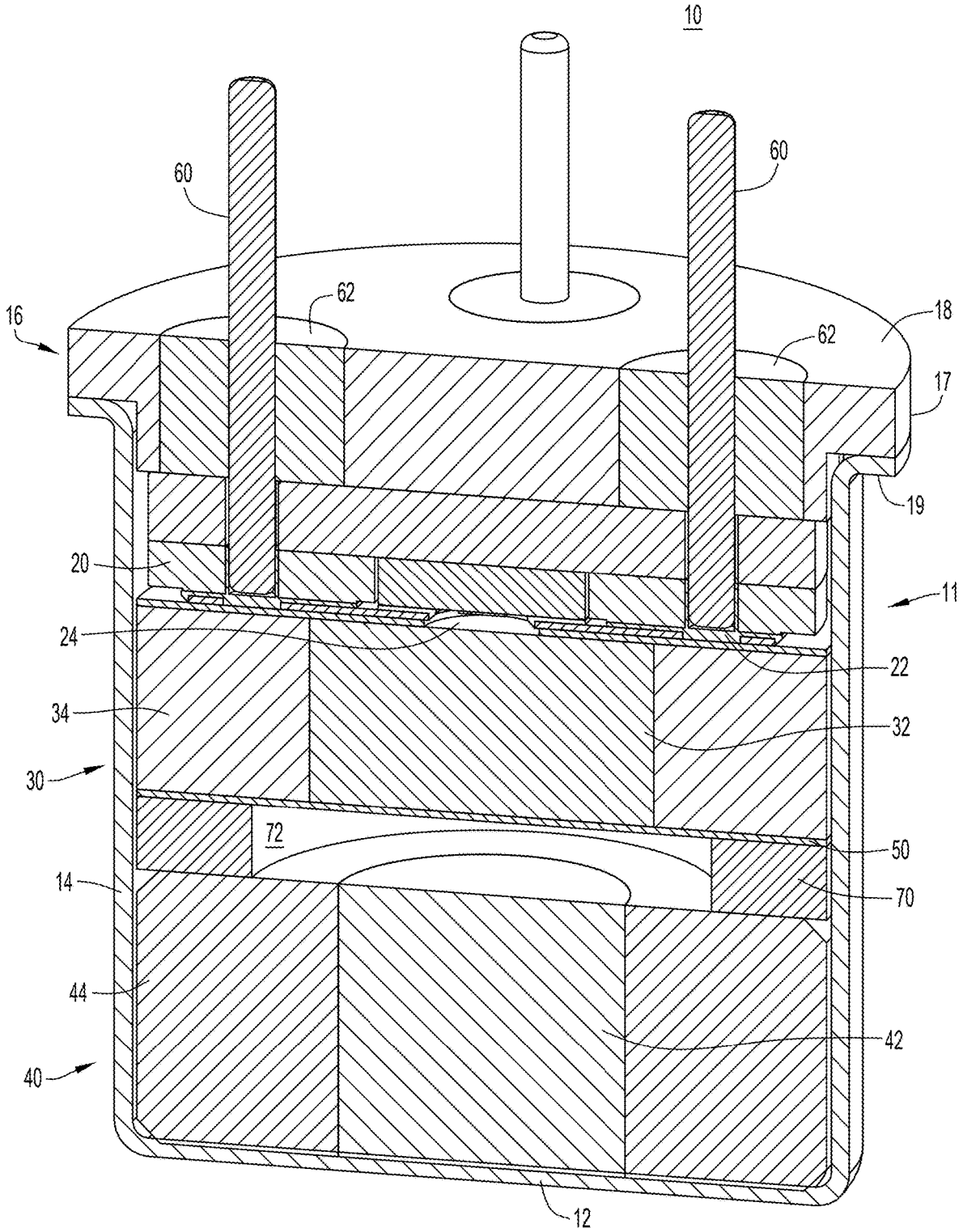
FIG. 1 is a cross-section view of a LEEFI according to some implementations.

Assemblies and methods are described more fully hereinafter with reference to the accompanying drawings. It will be readily understood that the assemblies and methods as generally described herein and illustrated in the appended drawings may be arranged and designed in a wide variety of different configurations. Thus, the following more detailed description of assemblies and methods, as represented in the drawings, is not intended to limit the scope of the present disclosure but is merely representative of various systems and methods. While various aspects are presented in the drawings, the drawings are not necessarily drawn to scale unless specifically indicated.

The techniques and approaches disclosed herein may be implemented in other specific forms without departing from its spirit or essential characteristics; that is, the described implementations are to be considered in all respects only as illustrative and not restrictive. The scope of inventions disclosed herein is therefore indicated by the appended claims rather than by this detailed description. All changes that come within the meaning and range of equivalency of the claims are to be embraced within their scope.

Reference throughout this specification to features, advantages, or similar language does not imply that all of the features and advantages that may be realized with the disclosed apparatus, system and method should be or are in any single implementation. Rather, language referring to the features and advantages is understood to mean that a specific feature, advantage, or characteristic described in connection with an implementation is included in at least one implementation. Thus, discussions of the features and advantages, and similar language, throughout this specification may, but do not necessarily, refer to the same implementation.

Furthermore, the described features, advantages, and characteristics of the disclosed principles may be combined in any suitable manner in one or more implementations. One skilled in the relevant art will recognize, in light of the description herein, that the implementations can be practiced without one or more of the specific features or advantages of a particular implementation. In other instances, additional features and advantages may be recognized in certain implementations that may not be present in all implementations.

Reference throughout this specification to "one implementation," "an implementation," or similar language means that a particular feature, structure, or characteristic described in connection with the indicated implementation is included in at least one implementation. Thus, the phrases "in one implementation," "in an implementation," and similar language throughout this specification may, but do not necessarily, all refer to the same implementation.

The relative terms "top", "bottom", "upper", "lower", and the like as used herein are for ease of reference in the description to merely describe points of reference and are not intended to limit any particular orientation or configuration of the described subject matter. In addition, references to annular shelves herein is not intended to be limited to those having continuous surfaces, but are also intended to encompass those made up of a series of spaced apart elements lying in a same plane.

FIG. 1 is a cross-sectional perspective view of a LEEFI 10. It is to be appreciated that the concepts disclosed and contemplated herein are not limited to any particular LEEFI configuration. In the example of FIG. 1, the LEEFI includes a casing 11 in which various internal components of the device are housed. These components generally include a bridge assembly 20, an input explosive pellet assembly 30 and an output explosive pellet assembly 40. The bridge assembly includes the exploding bridge foil 22 and a first flyer 24. The bridge foil 22 is connected to electrical leads 60 that connect it to a capacitor located on an electronics board (e.g. a printed circuit board). When the bridge foil 22 explodes in response to power stored in the capacitor being delivered to it, it drives the first flyer 24 into a first explosive pellet 32 located in the input explosive pellet assembly 30. When this occurs, the first explosive pellet 32 explodes to cause a burst disc 50 that separates the input explosive pellet assembly 30 and the output explosive pellet assembly 40 to fragment and drive a second flyer through a gap 72 and into a second explosive pellet 42 in the output explosive pellet assembly 40. When this occurs the second explosive pellet 42 explodes to cause the bottom surface 12 of the LEEFI casing 11 to fragment and drive a third flyer into, for example, an explosive payload of a bomb or another type of munitions platform. The gap 72 is disposed in what is commonly known as a barrel 70.

In the implementation of FIG. 1 the first and second explosive pellets 32 and 42 are respectively surrounded by first and second cylindrical aluminum sleeves 34 and 44. In addition, the casing 11 includes an upper part 16 through which the electrical leads 60 vertically protrude through glass filled apertures 62. The upper part 16 includes an external flange 17 having a top surface 18 and an opposite facing bottom surface 19.

Figure 2:
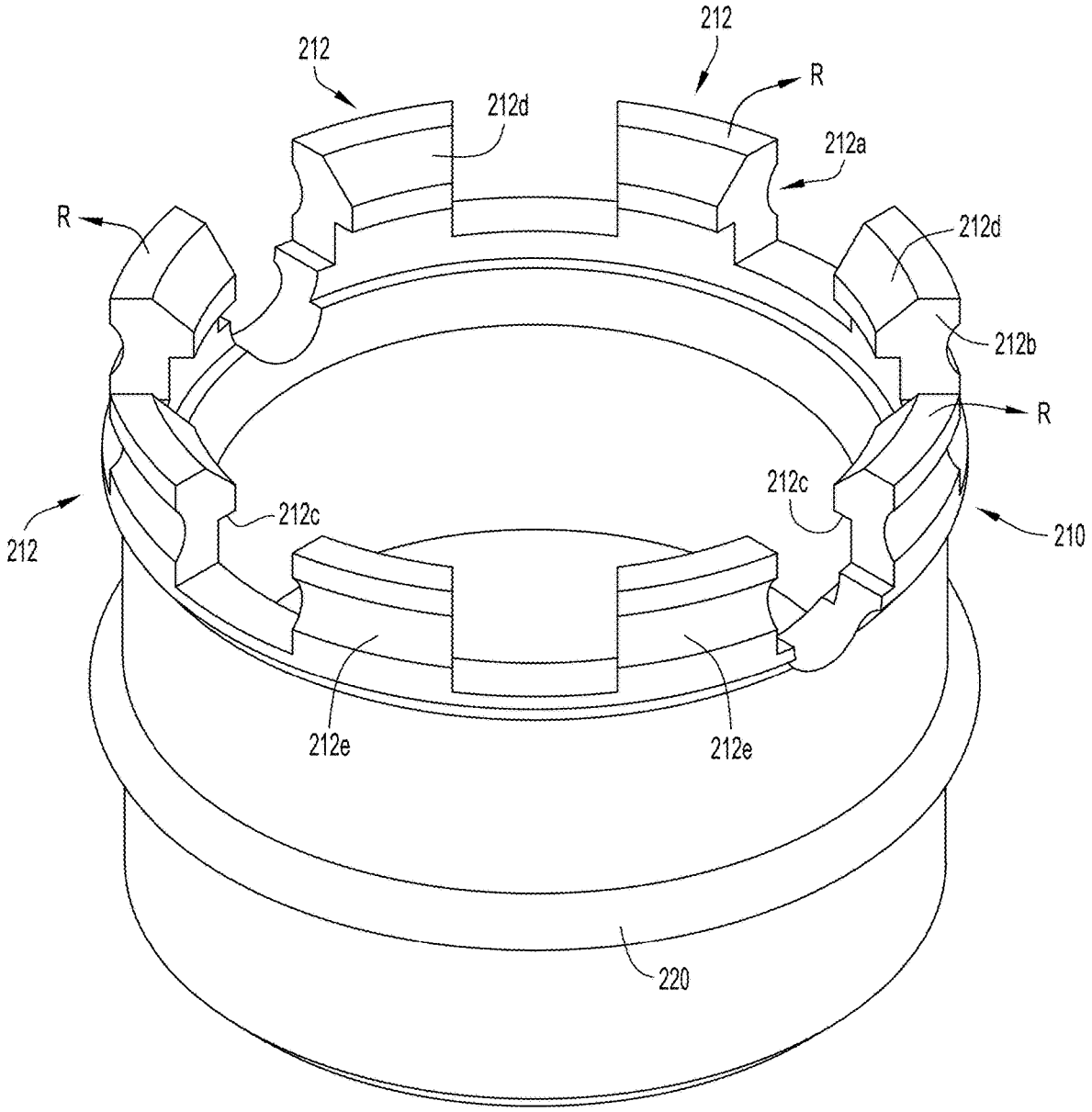
FIG. 2 is a perspective view of a sleeve that is configured to secure a LEEFI inside a housing of a fuse assembly.
Figure 8:
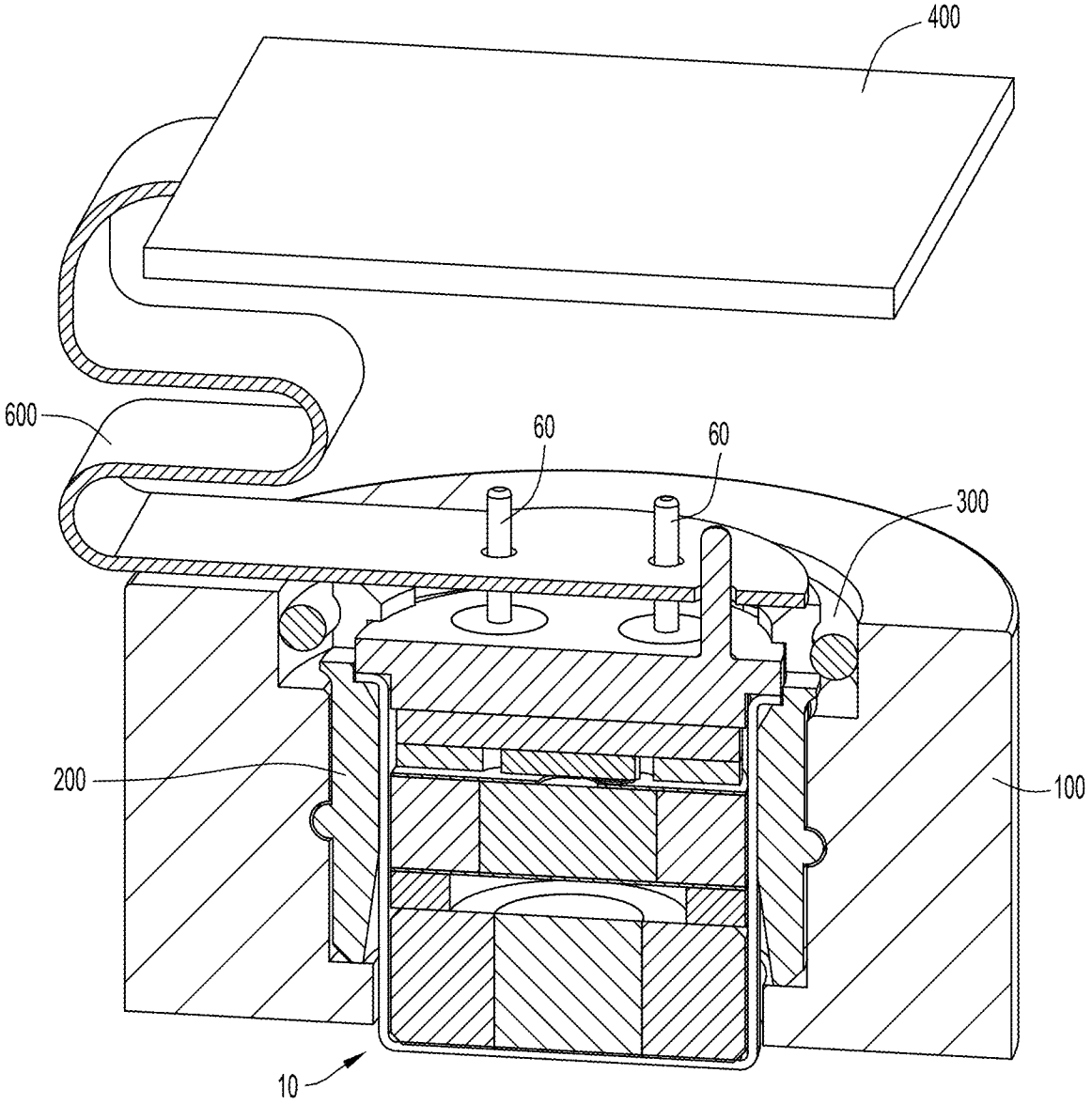
FIG. 8 shows the leads of the LEEFI coupled to a flexible electrical connector that enables the LEEFI to be coupled to a remote electronics board.

FIG. 8 is a cross-sectional perspective view of an assembled fuse assembly 90 according to one implementation. The fuse assembly includes a LEEFI 10, like that shown in FIG. 1, supported in a housing 100. As explained above, in use the housing 100 is attached to, for example, a munitions platform (not shown) that includes a bomb that is configured to be detonated by the LEEFI. The LEEFI 10 is supported in the housing 100 by a sleeve 200 made of a compliant material that protects the LEEFI by dampening shocks and vibrations applied to the housing 100. According to some implementations the sleeve 200 is a monolithic structure made of a single piece of material as shown in FIG. 2. According to some implementations the sleeve 200 is an injection molded urethane having a shore hardness of 95A. During assembly, the LEEFI casing 11 is press-fit into the sleeve 200 such that an interference fit exists between an outer side wall 14 of the casing 11 and in inner wall 201 of the sleeve 200. One end of the sleeve 200 includes an upper latch assembly 210 that has a plurality of tabs 212 that are circumferentially spaced-apart from one another. Each of the plurality of tabs 212 includes a cantilever beam 212*a* having a head 212*b* with a bottom surface 212*c* pressed against the top surface 18 of the casing flange 17 when the fuse assembly is in the assembled state. According to some implementations the head 212*b* of each of the plurality of tabs 212 includes a chamfered top surface 212*d* that facilitates an insertion of the LEEFI casing 11 into the through opening 202 of the sleeve 200. During the insertion the cantilever beams 212*a* flex radially outward to accommodate a passage of the LEEFI casing 11 into a through opening 202 of the sleeve 200.

Upon the LEEFI 10 being fully inserted into the housing as shown in FIGS. 5-8, the upper external flange 17 of the LEFFI casing 11 is sandwiched between the bottom surface 212*c* of the heads 212*b* and an annular shelf 260 located there below.

According to some implementations, the casing 11, the through opening 102 of the housing 100, and the through opening 202 of the sleeve 200 have a common central axis "y".

According to some implementations the fuse assembly 90 further includes a band 300 (e.g. O-ring) that is fitted into a groove 212*e* of each of the cantilever beams 212*a* after the tabs 212 have acted on the upper flange 17 of the LEEFI casing 11 to restrict axial movement of the LEEFI inside the sleeve. According to some implementations the band is made of a rigid material, such as, for example, a rigid silicone. The function of the band 300 is to restrict radial outward movement "R" of the cantilever beams 212*a* when the fuse assembly 100 is subjected to shock and vibrations. According to some implementations the rigidity of the band 300 is such that it's diameter does not change when being fitted inside the grooves 212*e* of the cantilever beams 212*a*.

According to some implementations the housing 100 and sleeve 200 include additional features that work together to restrict axial movement of the sleeve 200 inside the housing 100. According to some implementations these features include an annular groove 120 located in an inner wall 101 of the through opening 102 of the housing 100 and an annular protrusion 220 of the sleeve 200 that resides in the annular groove 120. These cooperating features assist in restricting axial movement of the LEEFI 10 inside the housing 100 when shock and vibrations are applied to the housing.

Figure 3:
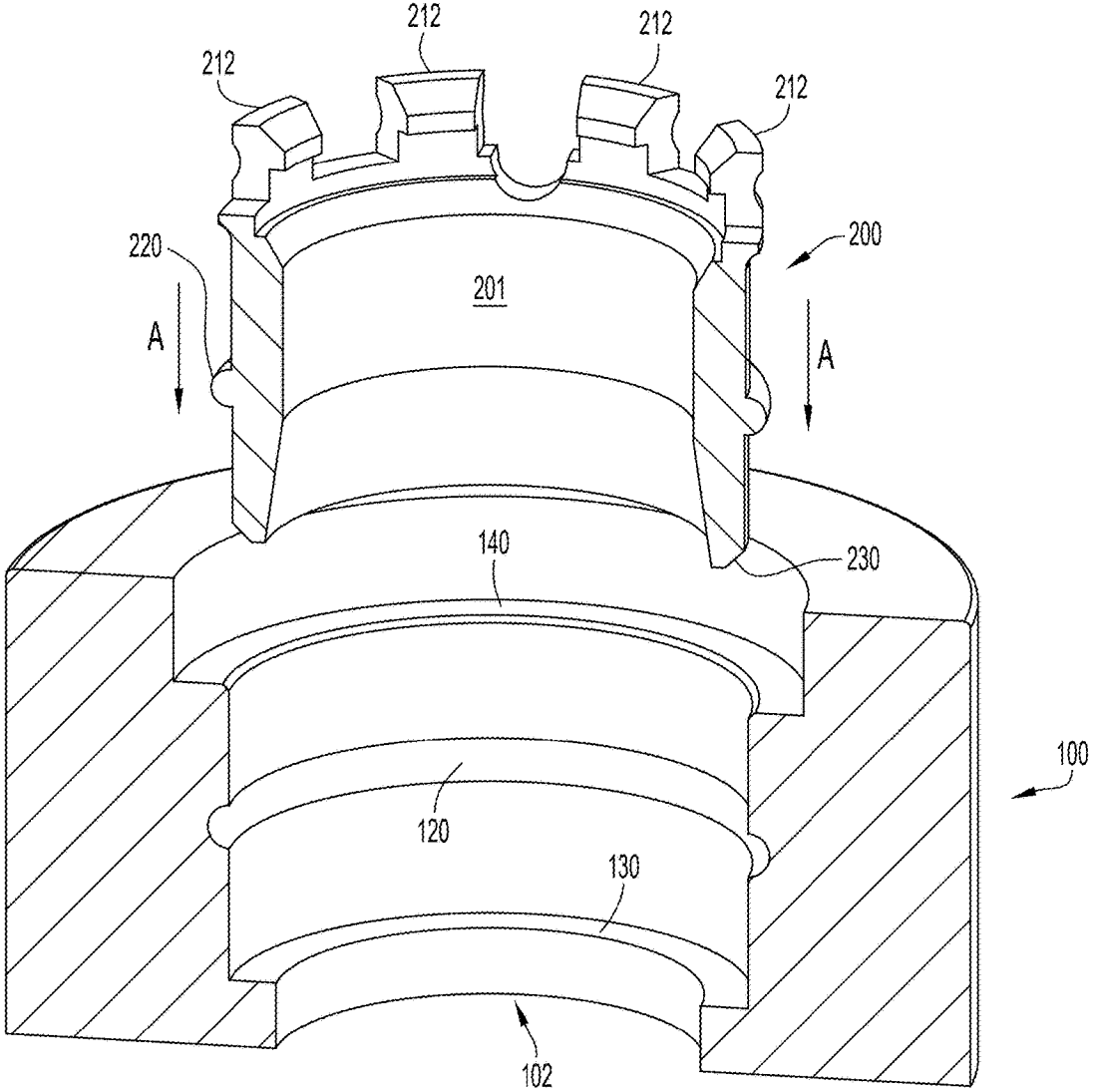
FIG. 3 is a cross-sectional perspective view of the sleeve of FIG. 2 being inserted into a housing of the fuse assembly.

Alternatively or in conjunction with the use of the annular groove 120 and protrusion 220 to restrict axial movement of the sleeve 200 inside the housing 100, the housing may further include one or more annular shelves on which respective one or more bottom facing surfaces of the sleeve rest. In the example of FIG. 3 the housing 100 includes a first annular shelf 130, a second annular shelf 140 located above the first annular shelf, with the annular groove 120 being disposed between them. In the implementations shown in the figures, the sleeve 200 includes an annular bottom surface 230 that is configured to rest on the first annular shelf 130 of the housing upon the sleeve being fully inserted into the housing 100. The sleeve 200 may also include a bottom facing surface 250 in an upper part thereof that is configured to rest on the second annular shelf 140 upon the sleeve being fully inserted into the housing 100. In the implementation of FIG. 3, the bottom facing surface 250 of the sleeve 200 is associated with lips 251 located at or below the base of the cantilever beams 212*a*.

According to some implementations the electrical leads 60 of the LEEFI 10 are electrically coupled to respective conductors (e.g. traces) of a flexible electrical connector 600 as shown in FIG. 8. According to some implementations the electrical leads are electrically coupled to a printed circuit board located away from the LEEFI by the flexible electrical connector. According to some implementations the printed circuit board comprises circuitry for controlling the activation of the LEEFI and is located in a part of the housing remote from the LEEFI casing.

Figure 4:
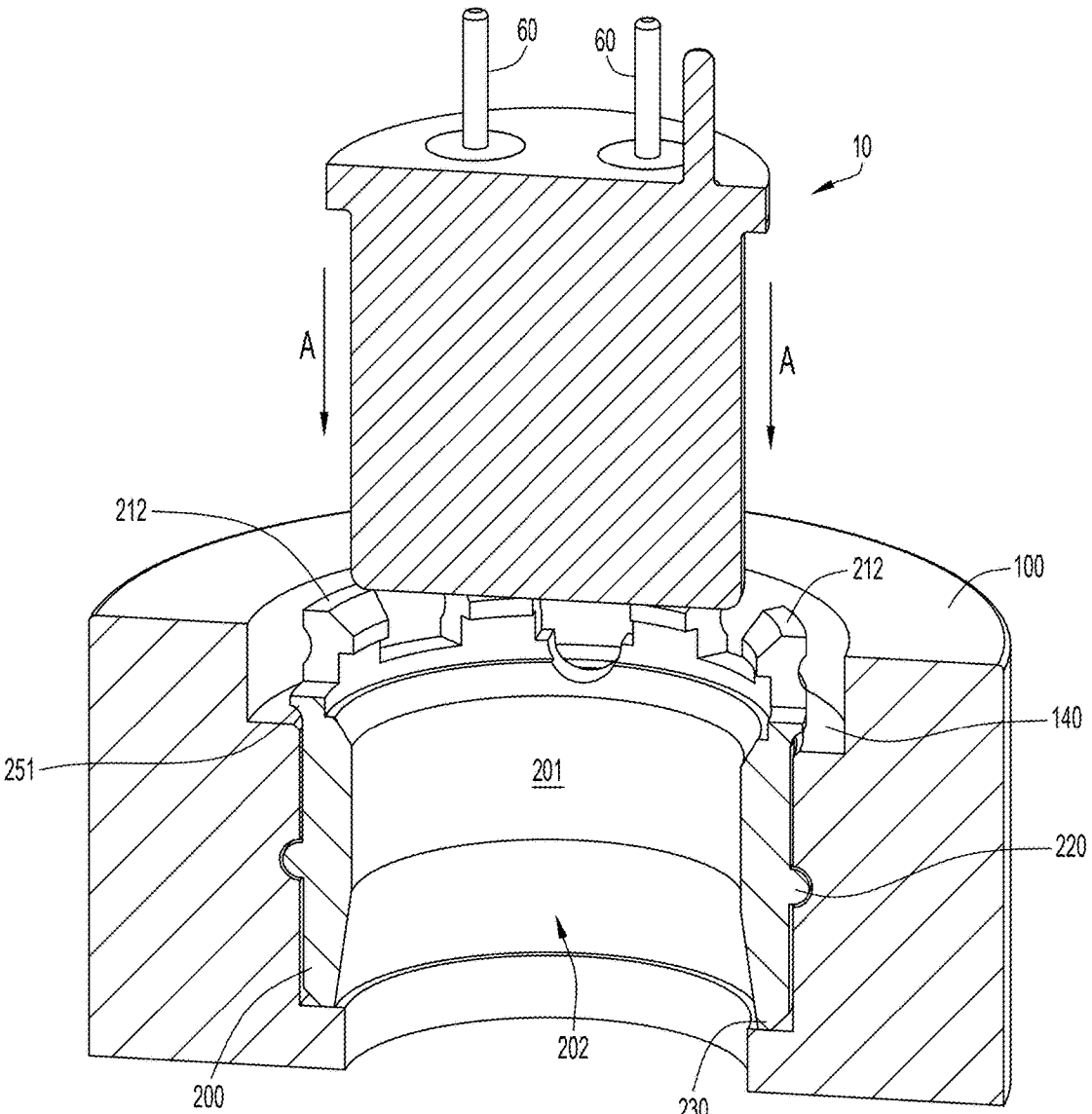
FIG. 4 is a cross-sectional perspective view showing the sleeve of FIGS. 2 and 3 retained inside the housing of FIG. 3, and a LEEFI being inserted into a through opening of the sleeve.
Figure 5:
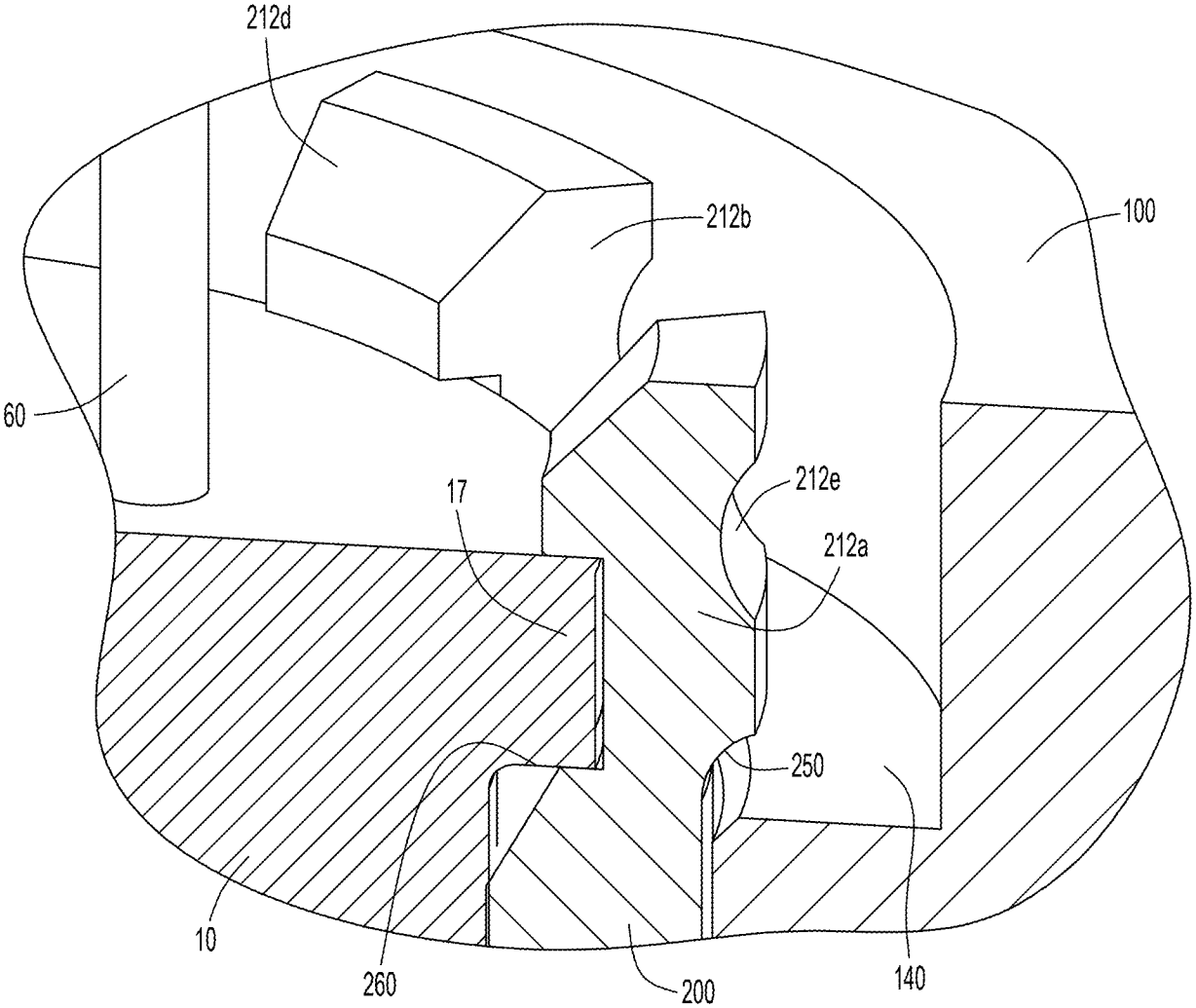
FIG. 5 is a partial perspective view of a part of the LEEFI casing being retained in the sleeve through the use of spaced-apart tabs of a latch assembly.
Figure 6:
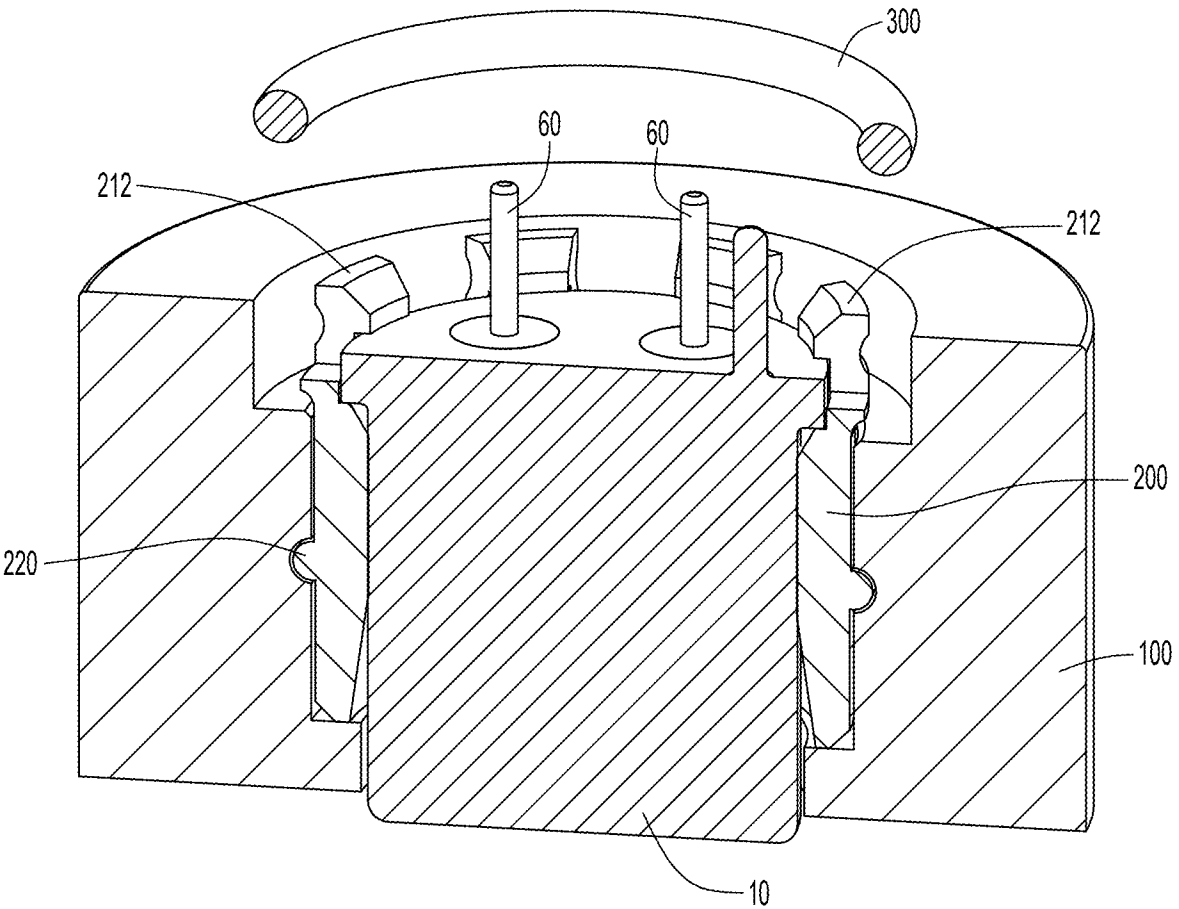
FIG. 6 is a cross-sectional perspective view of the LEFFI of FIG. 4 secured inside the sleeve with a band readied to be pressed onto and around the outer radial surfaces of the cantilever beams of the latch assembly.
Figure 7:
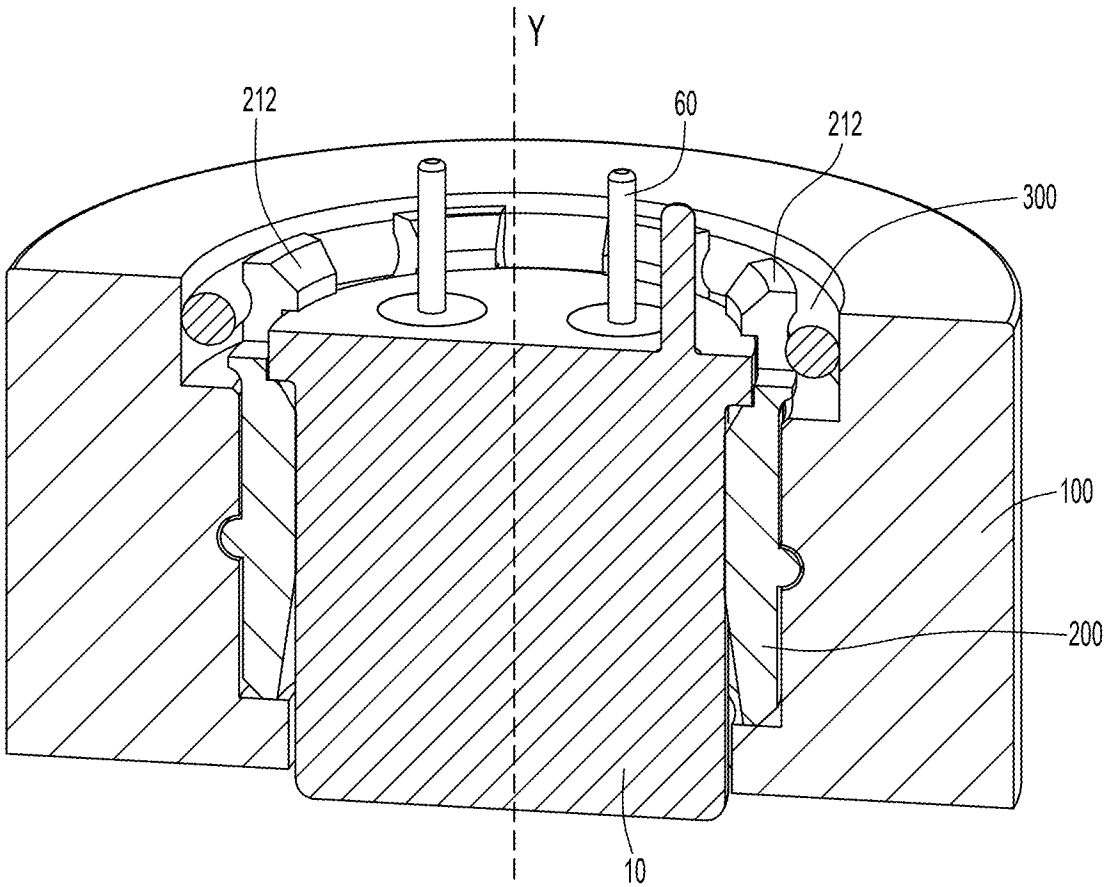
FIG. 7 shows the band surrounding and radially constraining the cantilever beams of the latch assembly.

Assembling the LEEFI 10 in the housing 100 involves a first insertion process that includes inserting the sleeve 200 into the through opening 102 of the housing 100. As noted above, the through opening 102 of the housing 100 is at least partially defined by an inner wall 201 having formed therein the annular groove 120. As shown in FIGS. 3 and 4, as the sleeve 200 is advanced in the insertion direction "A", its outer circumferential surface slides axially into the through opening 102 of the housing 100 until the annular protrusion 220 of the sleeve 200 resides inside the annular groove 120 of the housing. As shown in FIG. 4, at the completion of the first insertion process the bottom annular surface 230 of the sleeve may also rest on the first shelf 130 of the housing 100. At the completion of the first insertion process the bottom facing surface 250 of the sleeve located at the lip 251 may also rest on the second annular shelf 140 of the housing.

After the sleeve 200 has been secured inside the housing, a second insertion process is carried out that includes advancing in the insertion direction "A" the LEEFI casing 11 into the through opening 202 of the sleeve 200 as shown in FIG. 4 to cause the sleeve 200 to be disposed between the LEEFI casing and the inner wall 201 of the housing 100. As a result of the outer diameter of the LEEFI casing 11 being slightly larger than an inner diameter of the through opening 202 of the sleeve, at least a portion of the LEEFI casing is press-fit into the sleeve such that an interference fit exists between the circumferential outer wall 14 of the LEEFI casing and the inner wall 201 of the sleeve 200.

When the second insertion process is complete as shown in FIGS. 5-8, the LEEFI casing 11 is axially and radially constrained by the sleeve 200 in the manner disclosed above. Axial constrainment is achieved through the use of the sleeve latch assembly 210 acting on the LEEFI casing flange 17 (see FIG. 4). Radial constrainment is achieved by the establishment of the interference fit between the outer wall 14 of the LEEFI casing 11 and the inner wall 201 of the sleeve 200.

During the insertion of the LEEFI casing 11 into the through opening 202 of the sleeve 200, the bottom surface 12 of the casing acts on the chamfered surfaces 212*d* of the heads 212*b* of the cantilever beams 212*a* to cause the beams to flex radially outward in a direction "R" to make way for the axial passage of the casing into the through opening of the sleeve. Upon the upper annular flange 17 of the LEEFI casing 11 advancing a sufficient distance into the sleeve, the cantilever beams 212*a* subsequently flex radially inward to cause their heads 212*a* to press against the top surface 18 of the flange 17. Concurrently therewith, or at a time thereafter, the bottom surface 19 of the flange 17 is caused to be pressed against the annular shelf 260 of the sleeve 200.

According to some implementations, when the second insertion process is complete, the band 300 is applied around the cantilever beams 212*a* so that an inner surface of the band presses against the outer surfaces of the cantilever beams to restrict or prevent radial outward movement of the cantilever beams when the assembly is subjected to environmental loads (e.g. shock and/or vibration).

After the completion of the second insertion process the LEEFI leads 60 may be coupled to a control circuit located on an electronics board 400 spaced away from the LEEFI 10 as shown in FIG. 8. According to some implementations this is accomplished by soldering the leads 60 to traces in the flexible connector that are electrically connected to the control circuit.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

The invention claimed is:

1. A fuse assembly comprising:

a low energy exploding foil initiator that includes a casing with an external annular flange;

a housing including:

a through opening defined by an inner wall, the inner wall having an annular groove;

a first shelf; and a sleeve disposed between the low energy exploding foil initiator casing and the inner wall of the housing; the sleeve including:

an outer surface that is pressed against the inner wall of the housing;

an outer annular protrusion that resides in the annular groove of the housing;

a bottom surface that rests against the first shelf of the housing;

a shelf on which at least a portion of the external annular flange of the casing rests;

an upper latch assembly comprising a plurality of tabs that are circumferentially spaced-apart from one another, each of the plurality of tabs including a cantilever beam having a head, the head including a bottom surface pressed against a top surface of the external annular flange of the low energy exploding foil initiator casing.

2. The fuse assembly according to claim 1, wherein the housing includes a second shelf located above the first shelf, the annular groove being disposed between the first and second shelves, the sleeve having a lip with a bottom surface that is pressed against a top surface of the second shelf.

3. The fuse assembly according to claim 1, wherein the head of each of the plurality of tabs includes a chamfered top surface that facilitates an insertion of the low energy exploding foil initiator casing into the sleeve.

4. The fuse assembly according to claim 1, further comprising a band that circumscribes the plurality of tabs, at least a portion of the band residing in a groove of each of the cantilever beams and configured to restrict radial outward movement of the cantilever beams.

5. The fuse assembly according to claim 4, wherein the band is a rigid O-ring.

6. The fuse assembly according to claim 4, wherein the band is made of a rigid silicone.

7. The fuse assembly according to claim 1, wherein there exists an interference fit between the low energy exploding foil initiator casing and the inner wall of the sleeve.

8. The fuse assembly according to claim 1, wherein the sleeve is a monolithic structure made of a single piece of material.

9. The fuse assembly according to claim 1, wherein the sleeve is made of a shock absorbing material.

10. The fuse assembly according to claim 9, wherein the sleeve is a urethane injection molded structure having a shore hardness of 95 A.

11. The fuse assembly according to claim 1, wherein the housing is made of a material selected from the group consisting of steel and aluminum.

12. The fuse assembly according to claim 1, further comprising one or more electrical leads protruding from an end of the low energy exploding foil initiator casing, the one or more electrical leads being electrically coupled to a respective one or more traces of a flexible electrical connector.

13. The fuse assembly according to claim 12, wherein the one or more electrical leads are electrically coupled to a printed circuit board by the flexible electrical connector.

14. The fuse assembly according to claim 13, wherein the printed circuit board is located inside the housing.

15. A method of mounting a low energy exploding foil initiator inside a housing, the method comprising:

a first insertion process that includes inserting a sleeve into a through opening of the housing, the through opening being defined by an inner wall having an annular groove, the housing further including a first shelf inside the through opening that protrudes radially inward from the inner wall, the sleeve having an outer surface that is caused to press against the inner wall of the housing, and a bottom surface that is caused to rest against the first shelf when the first insertion process is complete, the sleeve further including an outer annular protrusion that is caused to at least partially reside in the annular groove of the housing during the first insertion process; and a second insertion process that includes inserting a casing of the low energy exploding foil initiator into a through opening of the sleeve so that the sleeve is disposed between the low energy exploding foil initiator casing and the inner wall of the housing, the sleeve including a shelf on which at least a portion of an external annular flange of the casing rests when the second insertion process is complete, the sleeve further including an upper latch assembly comprising a plurality of tabs that are circumferentially spaced-apart from one another, each of the plurality of tabs including a cantilever beam having a head, the head including a bottom surface that is caused to press against a top surface of the external annular flange of the low energy exploding foil initiator casing when the second insertion process is complete.

16. The method according to claim 15, wherein the housing includes a second shelf located above the first shelf, the annular groove being disposed between the first and second shelves, the sleeve having a lip with a bottom surface that is caused to press against a top surface of the second shelf when the first insertion process is complete.

17. The method according to claim 15, wherein the head of each of the plurality of tabs includes a chamfered top surface, during the second insertion process an outer surface of the low energy exploding foil initiator casing acts on each of the chamfered top surfaces to cause each of the heads to move radially outward to facilitate the insertion of the low energy exploding foil initiator casing into the sleeve.

18. The method according to claim 15, further comprising applying a band around the cantilever beams to restrict radial outward movement of the cantilever beams.

* * * * *